TUCKABLE STABILIZING CARRIER MEANS FOR HANDLING PORTABLE CONTAINERS

BACKGROUND OF THE INVENTION:

For carrying containers such as paper box containers C for filling beverage liquid or foods in the containers, a tray T preformed with a plurality of sockets S may be provided as shown in FIG. 10 for stably loading each container C within the several sockets S formed in the tray T for preventing its turning over of the filled liquid or foods. This can be well done in a restaurant or coffee shop. However, when the tray T is served for a takeaway meal, the tray T loaded with plural boxes should be carried by a buyer's two hands, causing a very inconvenient handling for carrying the tray and the boxes especially when taking away from a shop to a buyer's home.

For takeaway meal service, even the liquid containing boxes can be filled in a large paper bag or case for a long distance handling or for storage in a car, the boxes filled with liquid may be easily collapsed or falling down to cause liquid spillage or liquid contamination to the other objects.

It is therefore expected to invent a portable carrier for handling light contaners such as beverage paper box container or the like which can be carried conveniently and lightly.

SUMMARY OF THE INVENTION

The object of the present invention is to provide a tuckable carrier including an one-piece paper or plastic board having a pluralty of container holes formed in a central base plate portion, a pair of side-wing plate portions respectively protruding sidewardly from the central base plate portion having a plurality of retaining lugs respectively formed in a plurality of slots cut in each side-wing plate portion, and a pair of handle portions respectively formed on two outer end portions of the two side-wing plate portions adapted to be held by a user's hand, in which a plurality of portable containers such as paper boxes filled with beverage liquid or foods generally formed as truncated cone shape or prismatic shape tapered downwardly can be engageably inserted into the plurality of container holes to be stably retained by the retaining lugs when each slot is engaged with an upper side peripheral portion of each container and the two handle portions formed on the one-piece board can be tucked to be held by the user's hand for carrying the portable containers conveniently and stably.

DETAILED DESCRIPTION

As shown in FIGS. 1-6, the present invention comprises a carrier means 1 tucked from an one-piece board 10 made of a paper board or plastic board.

Figure 1:
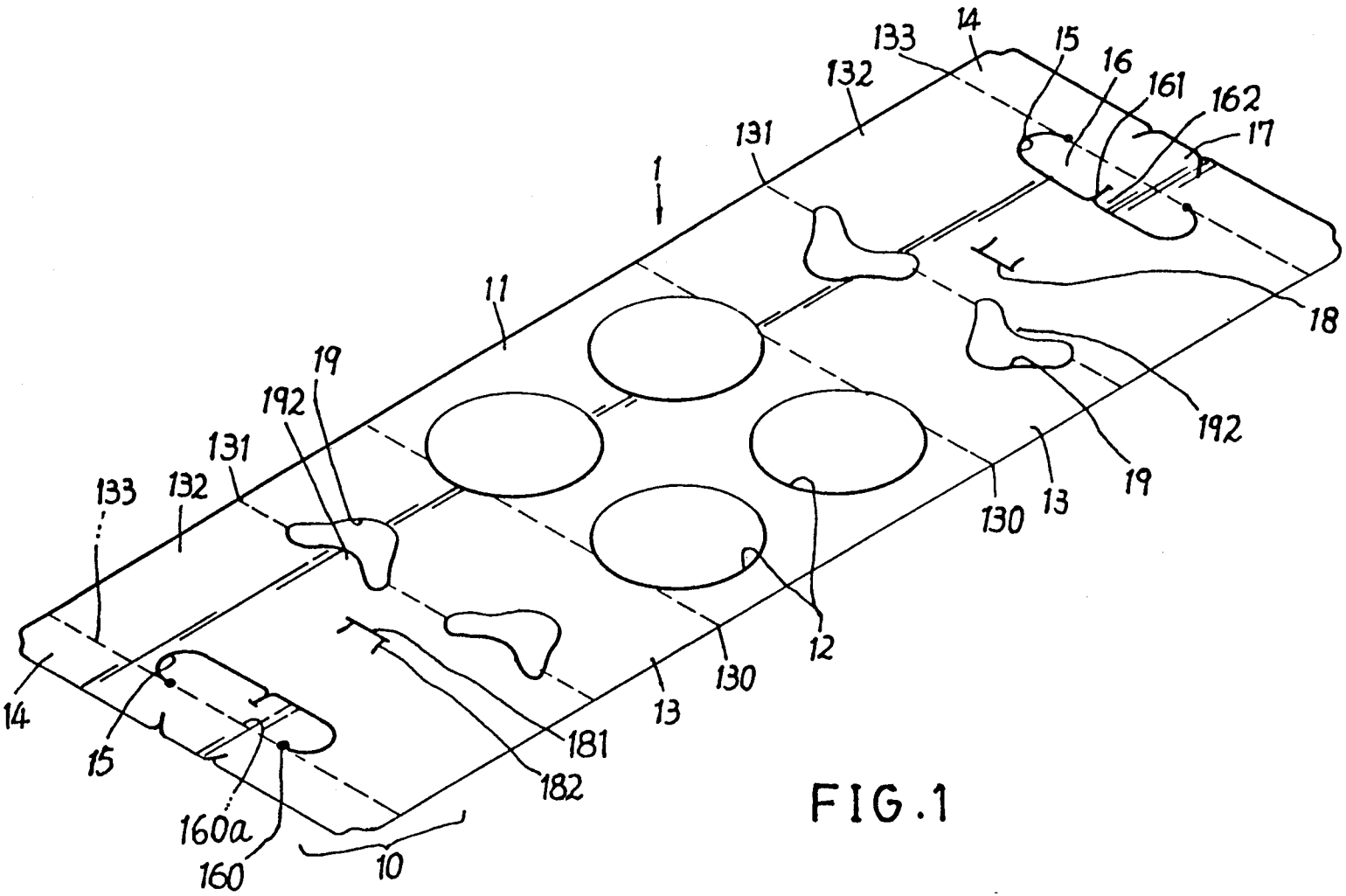
FIG. 1 is an illustration of an one-piece board for making a carrier means in accordance with the present invention.

The one-piece board 10 includes: a base plate portion 11 formed in a central portion of the one-piece board 10 having a plurality of container holes 12 such as four circular holes as shown in FIG. 1 formed in the base plate portion 11, a pair of side-wing plate portions 13 respectively protruding sidewardly outwardly from the base plate portion 11, and two handle portions 14 respectively formed on two outer end portions of the two side-wing plate portions 13.

Figure 9:
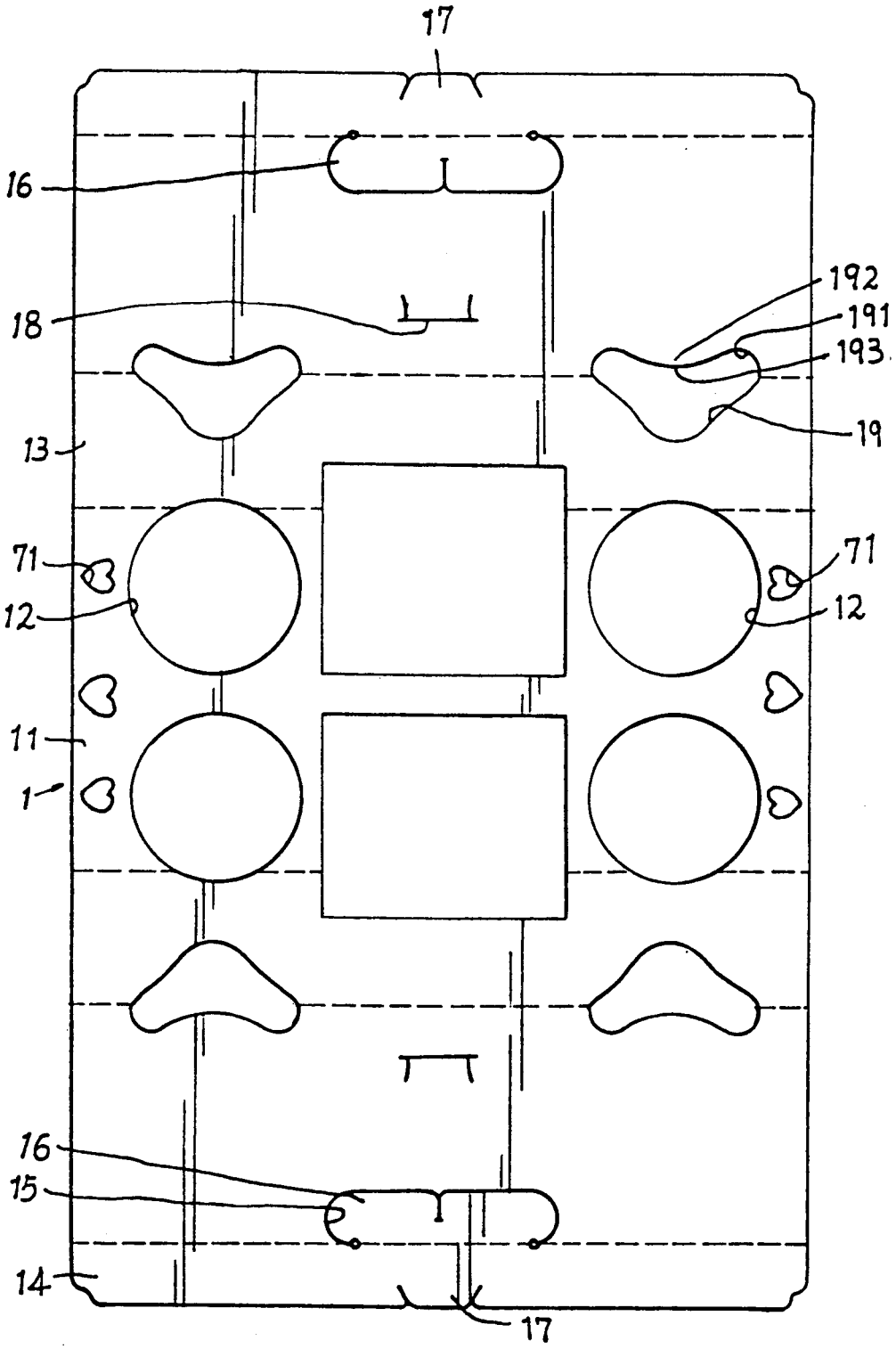
FIG. 9 shows still another preferred embodiment of the present invention.
Figure 10:
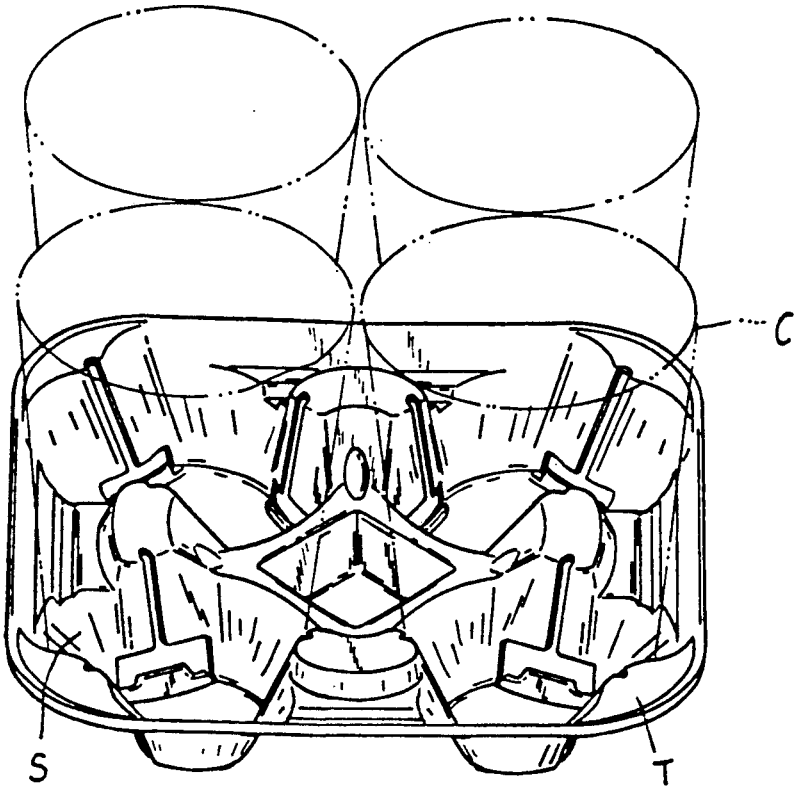
PRIOR ART FIG.10
FIG. 10 shows a prior art of a conventional tray for carrying liquid containers.

Each container hole 12 may be formed as circular or polygonal (such as square) shape engageable with a portable container 3 filled with beverage liquid or foods in the container generally formed as truncated cone or truncated prismatic (such as a tetragonal as shown in FIG. 9) shape tapered downwardly having an upper perimeter 31 larger in size than a lower perimeter 32 of the container 3.

Figure 4:
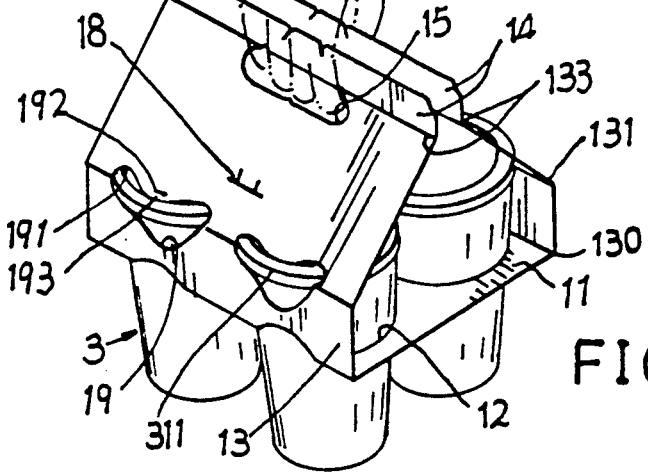
FIG. 4 shows a final step following FIG. 3.
Figure 5A:
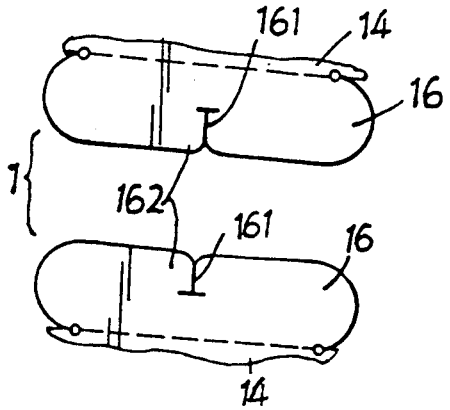
FIG. 5A shows a pair of interlockable flaps of the carrier means of the present invention.
Figure 5B:
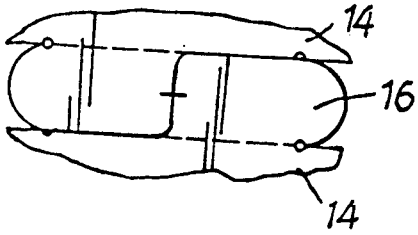
FIG. 5B shows the interlocked flaps of the present invention as shown in FIG. 5A.
Figure 5:
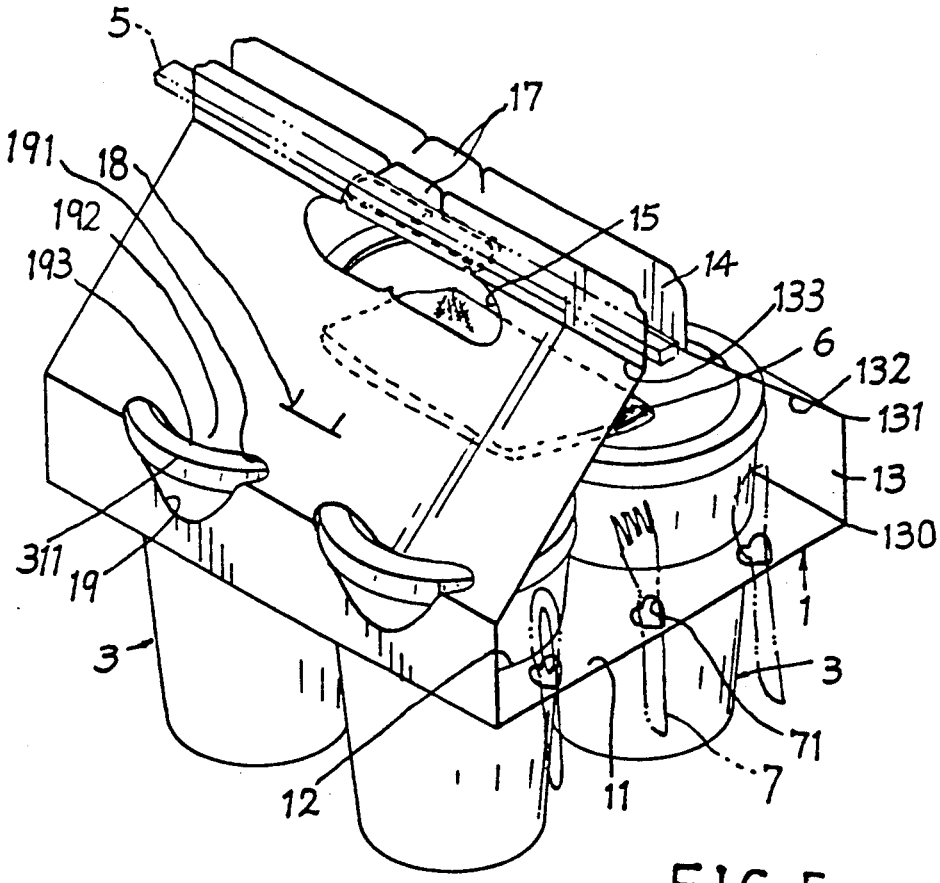
FIG. 5 is a perspective view of the present invention.

Each side-wing plate portion 13 includes: a bottom tuck line 130 formed between each side-wing plate portion 13 and the base plate portion 11 for vertically tucking the side-wing plate portion upwardly from the base plate portion 11 as shown in FIG. 4, a convex wing tuck line 131 longitudinally formed on a lower portion of the side-wing plate portion 13, a concave wing tuck line 133 longitudinally formed on an upper portion of each side-wing plate portion 13 above the convex wing tuck line 131 to define a convergent wing portion 132 between the convex tuck line 131 and the concave tuck line 133, and the concave wing tuck line 133 pertaining each handle portion 14 secured to each side-wing plate portion 13.

Each side-wing plate portion 13 is longitudinally formed with a plurality of container-extendible slots 19 adjacent to and disposed along the convex tuck line 131, each slot 19 having a retaining lug 192 protruding inwardly downwardly from an upper slot edge 191 of the slot 19 and tapered inwardly downwardly to form a lower edge portion 193 for operatively retaining an upper side peripheral portion of each container 3 engageably held in each container hole 12.

The container-extendible slot 19 may be generally triangular shaped or formed as other suitable shapes, which are not limited in this invention.

Figure 2:
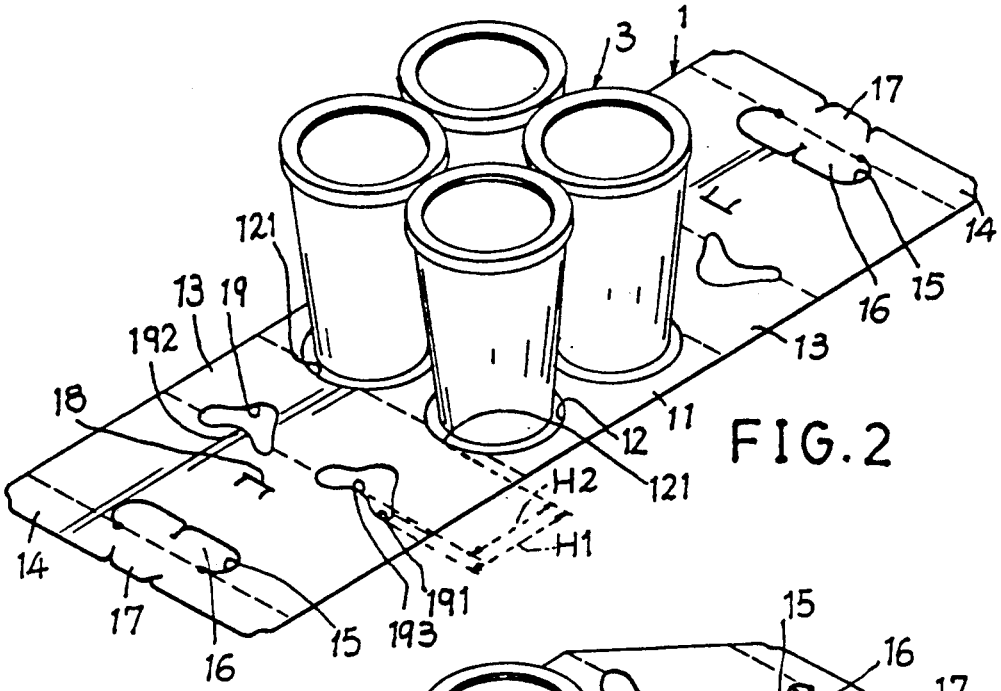
FIG. 2 shows a first step for carrying containers by the carrier means of the present invention.
Figure 3:
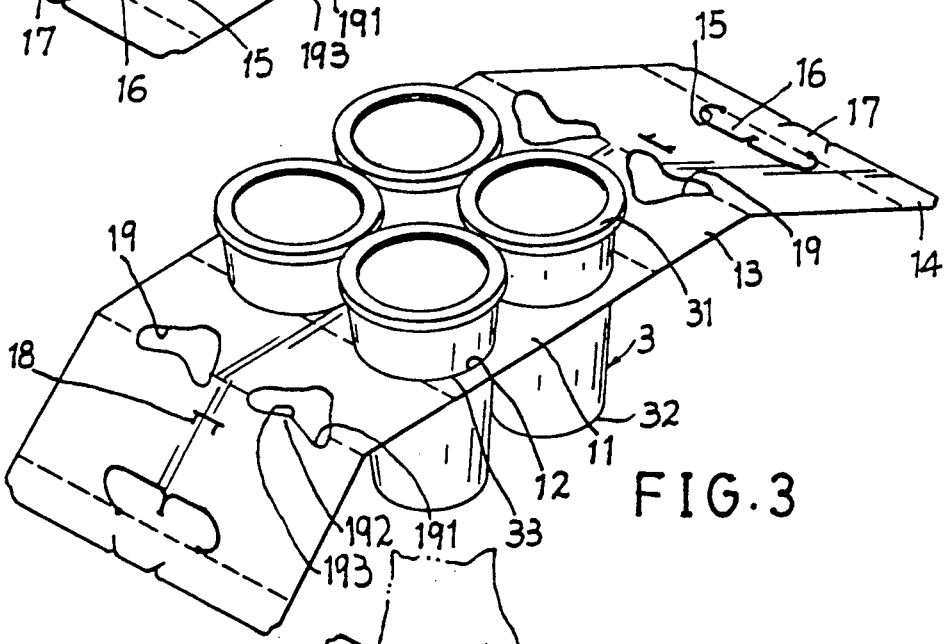
FIG. 3 shows a second step following FIG. 2.
Figure 6:
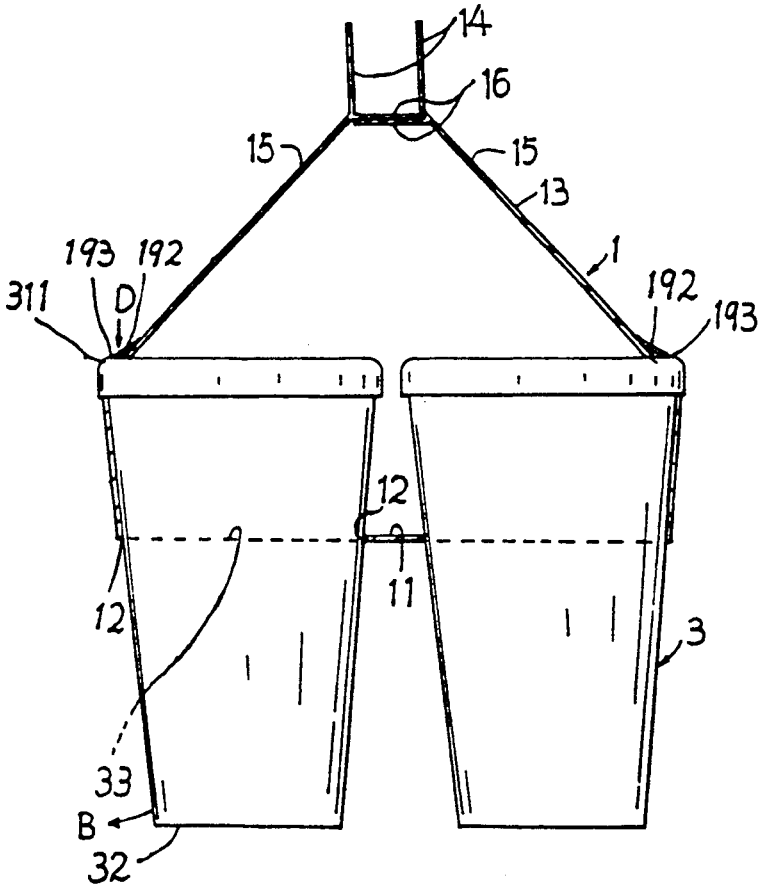
FIG. 6 is a side view of the present invention when tucked for carrying containers.
Figure 7:
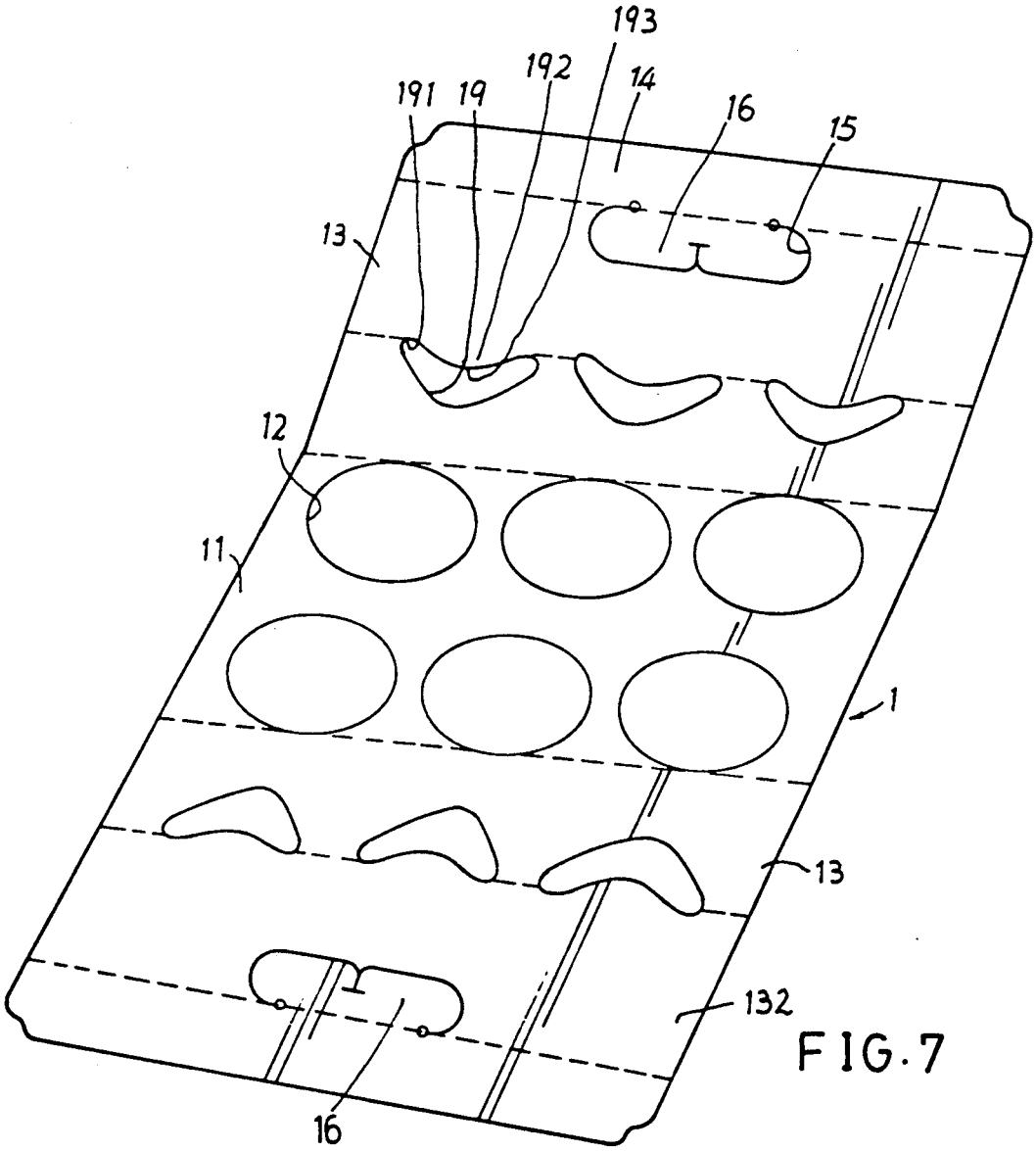
FIG. 7 shows another preferred embodiment of the present invention.
Figure 8:
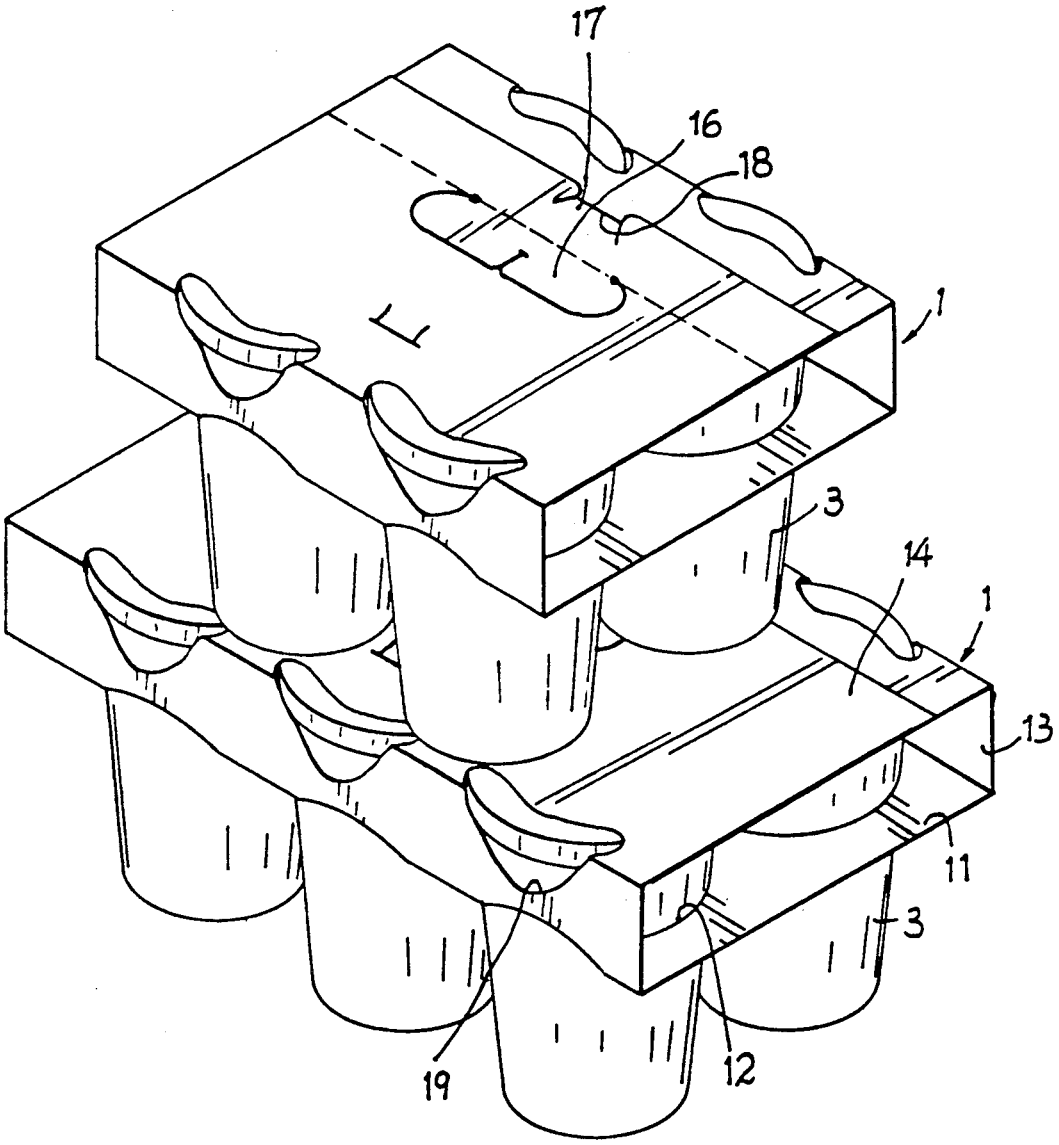
FIG. 8 shows a piling application of the present invention.

As shown in FIGS. 6 and 2, a distance H1 between an upper slot edge 191 of the slot 19 and an outermost side edge peripheral portion 121 of the container hole 12 should be larger than a height H between an upper side peripheral portion 311 of the container 3 and a corresponding annular ring portion 33 of each container 3 engageable with the container hole 12 ($H1>H$); and a distance H2 between the lowest edge portion 193 of the containing lug 192 and the outermost side edge peripheral portion 121, of the container hole 12 should be smaller than the height H between the upper side peripheral portion 311 of the container 3 and the corresponding annular ring portion 33 of the container 3 ($H2<H$).

shape engageable with a portable container filled with beverage liquid and foods in the container generally formed as truncated prismatic shape tapered downwardly having an upper perimeter larger in size than a lower perimeter of the container.

6. A tuckable carrier means according to claim 1, wherein a plurality of eating utensil holes are formed in a side edge portion of the base plate portion of the carrier means for holding a plurality of eating utensils selected from a knife, a spoon and a fork in the utensil holes.

7. A tuckable carrier means according to claim 1, wherein each said side-wing plate portion includes: a bottom tuck line formed between each said side-wing plate portion and the base plate portion for vertically tucking the side-wing plate portion upwardly from the base plate portion, a convex wing tuck line longitudinally formed on a lower portion of the side-wing plate portion, a concave wing tuck line longitudinally formed on an upper portion of each said side-wing plate portion above the convex wing tuck line to define a convergent wing portion between the convex tuck line and the concave tuck line, and the concave wing tuck line pertaining each said handle portion secured to each said side-wing plate portion, said slots formed in said wing plate portion adjacent to and generally disposed along said convex wing tuck line.

8. A tuckable carrier means according to claim 1, wherein each said handle portion is formed with a handhole cutout in a lower portion of the handle portion adapted to be held by a user's hand when the two side-wing plate portions are tucked along the convex tuck line to form the two convergent wing portions converging inwardly with each other, and then tucked along the concave tuck line to vertically erect the two handle portions from the two convergent wing portions.

9. A carrier means according to claim 8, wherein each said handle portion includes an interlockable flap protruding inwardly from a flap tuck line formed on an edge portion of the handhole cutout having a T-shaped slit notched in a central edge portion of the flap to form a pair of locking tabs on an inner edge portion of the flap separated by the T-shaped slit so that a left locking tab of a left handle portion is interlockable with a right locking tab of a right handle portion for linking the two handle portions for carrying the carrier means by poking a user's hand through each said cutout formed in each said handle portion.

10. A carrier means according to claim 9, wherein a stress-immune perforation is formed at an intersected point crossed by the flap and a flap tuck line formed on an edge portion of the cutout.

11. A carrier means according to claim 8, wherein said handle portion is formed with an embedding tongue portion on an outer edge portion of the handle portion, operatively engageable with a tongue-receiving slit generally Pi-shaped formed in a convergent wing portion of a side-wing plate portion of said carrier means so that a right tongue portion is engageably inserted into a left tongue-receiving slit for planarly embedding a right handle portion on a left handle portion for piling a plurality of carrier means and containers loaded on the carrier means 1.

* * * * *

US005127520A

United States Patent [19]

Thomas

[11] Patent Number: 5,127,520

[45] Date of Patent: Jul. 7, 1992

[54] CLAMSHELL AIRCRAFT BRAKE ASSEMBLY SHIPPING CONTAINER

[76] Inventor: William A. Thomas, 2444 Santa Ynez Way, Palm Springs, Calif. 92264

[21] Appl. No.: 737,785

[22] Filed: Jul. 30, 1991

[51] Int. Cl.[5] ..... B65D 85/02

[52] U.S. Cl. ..... 206/303; 220/4.22

[58] Field of Search ..... 206/303, 335, 408, 445, 206/446, 449, 452; 220/4.22, 4.23, 4.24

[56] References Cited

U.S. PATENT DOCUMENTS

| | | | |
|---|---|---|---|
| 2,613,807 | 10/1952 | Higbee | 206/319 |
| 2,708,509 | 5/1955 | Gould et al. | 220/4.22 |
| 2,728,581 | 12/1955 | Goebert et al. | 220/4.22 |
| 3,727,795 | 4/1973 | Willsey | 220/4.24 |
| 3,762,600 | 10/1973 | Kreutzweiser | 220/4.24 |
| 3,913,735 | 10/1975 | Durbin | 206/303 |
| 4,729,478 | 3/1988 | Thomas | 206/591 |
| 4,790,430 | 12/1988 | Thomas | 206/303 |
| 5,048,679 | 9/1991 | Thomas | 206/303 |

FOREIGN PATENT DOCUMENTS

| | | | |
|---|---|---|---|
| 0128422 | 6/1931 | Austria | 206/445 |
| 0870058 | 6/1961 | United Kingdom | 220/4.22 |

*Primary Examiner*—Jimmy G. Foster
*Assistant Examiner*—R. Zimmerman
*Attorney, Agent, or Firm*—Poms, Smith, Lande and Rose

[57] ABSTRACT

A lightweight impact resistant container for protecting aircraft brake assembly during shipment and minimizing the required amount of handling during installation and removal of the brake assembly from the aircraft is disclosed. The device is comprised of a cylindrical tube, a base portion, and a top portion, each of which are divided in half along the axis of the cylindrical tube. The two halves are hinged together to allow the two halves to pivot open and shut. When the container is shut, latches are used to secure the container in a closed position. The container further includes a threaded rod assembly with two conical members threaded on the rod for supporting and holding the brake assembly in a fixed position during shipment and storage. The threaded rod assembly mechanically interfits with the top portion and the base portion of the container.

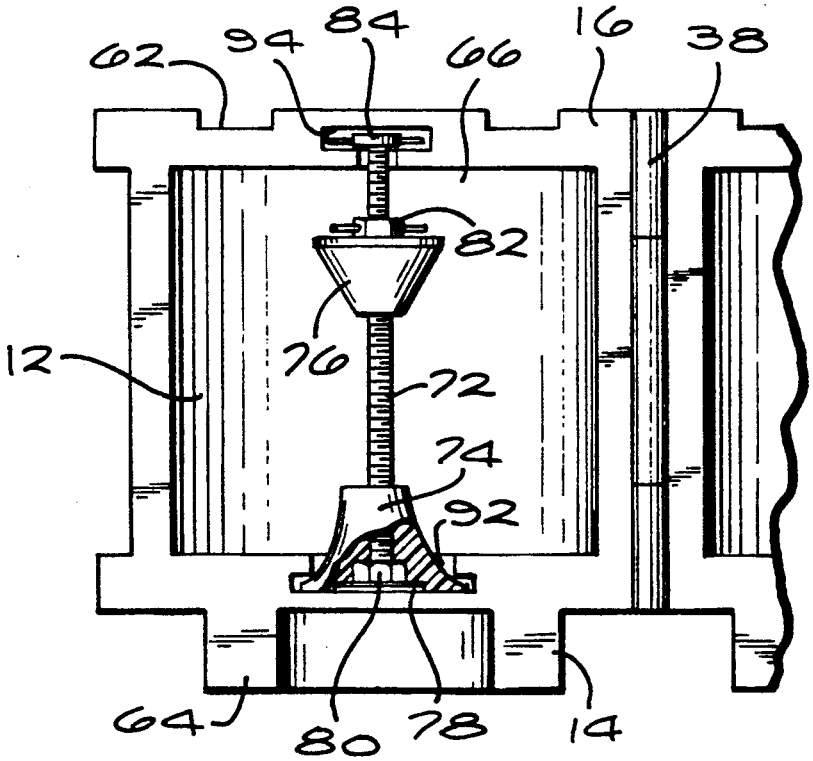

20 Claims, 2 Drawing Sheets